US006357420B1

(12) United States Patent
Matta

(10) Patent No.: US 6,357,420 B1
(45) Date of Patent: Mar. 19, 2002

(54) METHOD OF TUNING HYRAULICALLY ACTUATED FUEL INJECTION SYSTEMS BASED ON ELECTRONIC TRIM

(75) Inventor: George M. Matta, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/614,337

(22) Filed: Jul. 12, 2000

Related U.S. Application Data

(63) Continuation of application No. 09/162,034, filed on Sep. 28, 1998, now Pat. No. 6,112,720.

(51) Int. Cl.[7] ..... F02M 37/04
(52) U.S. Cl. ..... 123/446; 123/494; 73/119 A
(58) Field of Search ..... 123/446, 447, 123/494, 456; 73/119 A

(56) References Cited

U.S. PATENT DOCUMENTS

| | | | | |
|---|---|---|---|---|
| 3,421,486 A | | 1/1969 | Parrish | |
| 3,745,817 A | * | 7/1973 | Williams et al. | 73/117.3 |
| 4,037,467 A | | 7/1977 | Emerson | |
| 4,202,207 A | * | 5/1980 | Johnson et al. | 73/119 A |
| 4,206,634 A | | 6/1980 | Taylor et al. | |
| 4,487,181 A | | 12/1984 | Moore et al. | |
| 4,763,626 A | | 8/1988 | Staerzl | |
| 4,977,872 A | * | 12/1990 | Hartopp | 123/198 A |
| 5,297,523 A | | 3/1994 | Hafner et al. | |
| 5,459,664 A | | 10/1995 | Buckalew | |
| 5,485,820 A | | 1/1996 | Iwaszkiewicz | |
| 5,564,391 A | | 10/1996 | Barnes et al. | |
| 5,575,264 A | | 11/1996 | Barron | |
| 5,586,538 A | | 12/1996 | Barnes | |
| 5,634,448 A | | 6/1997 | Shinogle et al. | |
| 5,641,891 A | | 6/1997 | Frankl et al. | |
| 5,697,339 A | | 12/1997 | Esposito | |
| 5,747,684 A | | 5/1998 | Pace et al. | |
| 5,839,420 A | | 11/1998 | Thomas | |
| 6,102,005 A | * | 8/2000 | Kasen et al. | 123/446 |

* cited by examiner

*Primary Examiner*—Carl S. Miller
(74) *Attorney, Agent, or Firm*—Liell & McNeil

(57) ABSTRACT

A method for adjusting the on-time of each hydraulically-actuated fuel injector within a hydraulically-actuated fuel injection system is disclosed. At least two spray tests are performed on the fuel-injector prior to its installation in a fuel injection system. The fuel injector is marked with a bar-code capable of representing these results. Immediately prior to installing the fuel injector into the fuel injection system, the bar-code on the fuel injector is scanned and the results of the spray tests are stored in a memory unit accessible to the electronic control module. These results are used to develop a unique electronic trim solution for the fuel injector. The performance of the fuel injector is then adjusted using the electronic trim solution to enable the performance of the fuel injector to approach that of a nominal injector.

12 Claims, 4 Drawing Sheets

NOMINAL
ACTUAL

NOMINAL
CORRECTED

NOMINAL
ACTUAL

NOMINAL
CORRECTED

NOMINAL
ACTUAL

NOMINAL
CORRECTED

NOMINAL
ACTUAL

NOMINAL
CORRECTED

NOMINAL
ACTUAL

NOMINAL
CORRECTED

NOMINAL
ACTUAL

NOMINAL
CORRECTED

METHOD OF TUNING HYRAULICALLY ACTUATED FUEL INJECTION SYSTEMS BASED ON ELECTRONIC TRIM

RELATION TO OTHER PATENT APPLICATION

The present application is a continuation of pending patent application Serial No. 09/162,034, filed Sept. 28, 1998, now U.S. Pat. No. 6,112,720 and entitled Method Of Tuning Hydraulically-Actuated Fuel Injection Systems Based On Electronic Trim.

TECHNICAL FIELD

The present invention relates generally to a method of operating hydraulically-actuated fuel injection systems and, more particularly to a method of tuning each hydraulically-actuated fuel injector within the hydraulically-actuated fuel injection system.

BACKGROUND ART

Hydraulically-actuated fuel injection systems typically utilize an electronic control module to control the timing and the quantity of fuel injected into the engine. One function of the electronic control module is to store optimum fuel injection system operating parameters. This stored information relates to performance of a theoretical, nominal injector. Because performance of actual fuel injectors rarely conforms to the standards of the nominal injector, it is desirable to alter the actual operating conditions of the fuel injection system to correct for the performance of the actual fuel injectors. FIG. 4 shows an example of a nominal fuel injector trace compared to that of one actual fuel injector at one operating condition. In this example, the actual fuel injector differs from the nominal injector in both start of the injection (SOI) and in the mass quantity of fuel injected, which relates to the duration of the injection event. This actual injector could be made to perform more like the nominal injector if the SOI and the on-time were both adjusted. The present invention is directed to adjusting only the on-time of the injector and not the SOI.

This alteration could be made as a function of the average fuel consumed by all fuel injectors operating in a fuel injection system. After a fuel injector is manufactured, and prior to its installation in an engine, a single spray test is performed at one operating condition to measure a test volume of fuel injected by the fuel injector. An acceptable range of results is predetermined by expected performance of a nominal injector at that condition. If the result of the spray test for a fuel injector falls within the acceptable range, the result is recorded and the fuel injector is marked with a serial number. If the result of the spray test falls outside of the acceptable range, the fuel injector is rejected.

When the accepted fuel injectors are installed into the fuel injection system, a system-wide adjustment could be instituted based on a comparison of actual fuel consumed and expected fuel consumed. The total volume of fuel that should have been injected is determined based on a fuel injection system including nominal fuel injectors. For example, if the fuel injection system includes six fuel injectors, the nominal volume is calculated by adding up the predicted volume consumed by six nominal fuel injectors. A comparison of the actual volume consumed with the nominal volume is used to calculate a single on-time adjustment that is applied to all fuel injectors in the system. Because all fuel injectors are now made to operate at a level determined from their average performance, some injectors are going to perform better than before the correction, but others are going to perform worse. While the engine with such an average correction will perform overall closer to nominal expectations, engine vibration, noise and emissions may not be reduced because not all fuel injectors are performing at a better level. In one or more cases, the engine vibration, noise or emissions might actually increase.

An occasional increase in some of the undesirable engine outputs is an indication that a particular method of adjusting the on-time of fuel injectors fails to acknowledge that all fuel injectors perform differently with respect to each other. Engineers have observed that not only do fuel injectors behave differently with respect to each other, but that an individual fuel injector may also behave differently at different operating conditions. Therefore, while an average adjustment may enable the fuel injection system to perform better at one operating condition, the fuel injection system might in fact perform worse at a different operating condition.

The present invention is directed to overcoming one or more of the problems set forth above and to improving the performance of hydraulically-actuated fuel injection systems.

DISCLOSURE OF THE INVENTION

A method of tuning a hydraulically-actuated fuel injection system, which includes at least one hydraulically-actuated fuel injector, requires performance of at least two tests on each fuel injector. These tests are performed at a first condition and a second condition, and the results for each test are recorded. The recorded results are then compared to the expected results of a nominal injector at the same conditions. If this comparison yields a difference between the fuel injector and the nominal injector, the on-time for the fuel injector is adjusted accordingly.

BEST MODE FOR CARRYING OUT THE INVENTION

Figure 1:
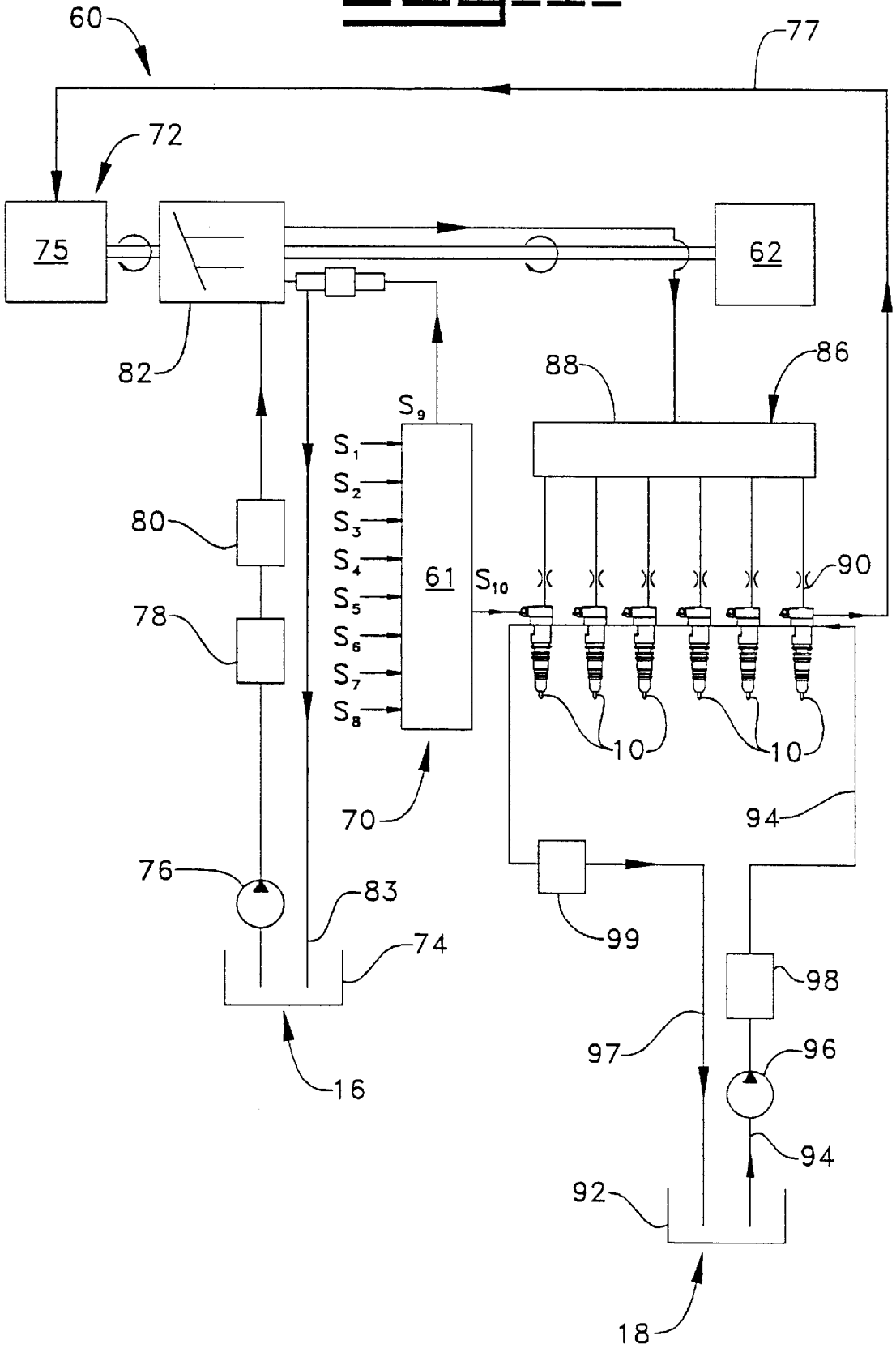
FIG. 1 is a schematic representation of a hydraulically-actuated fuel injection system.
Figure 2:
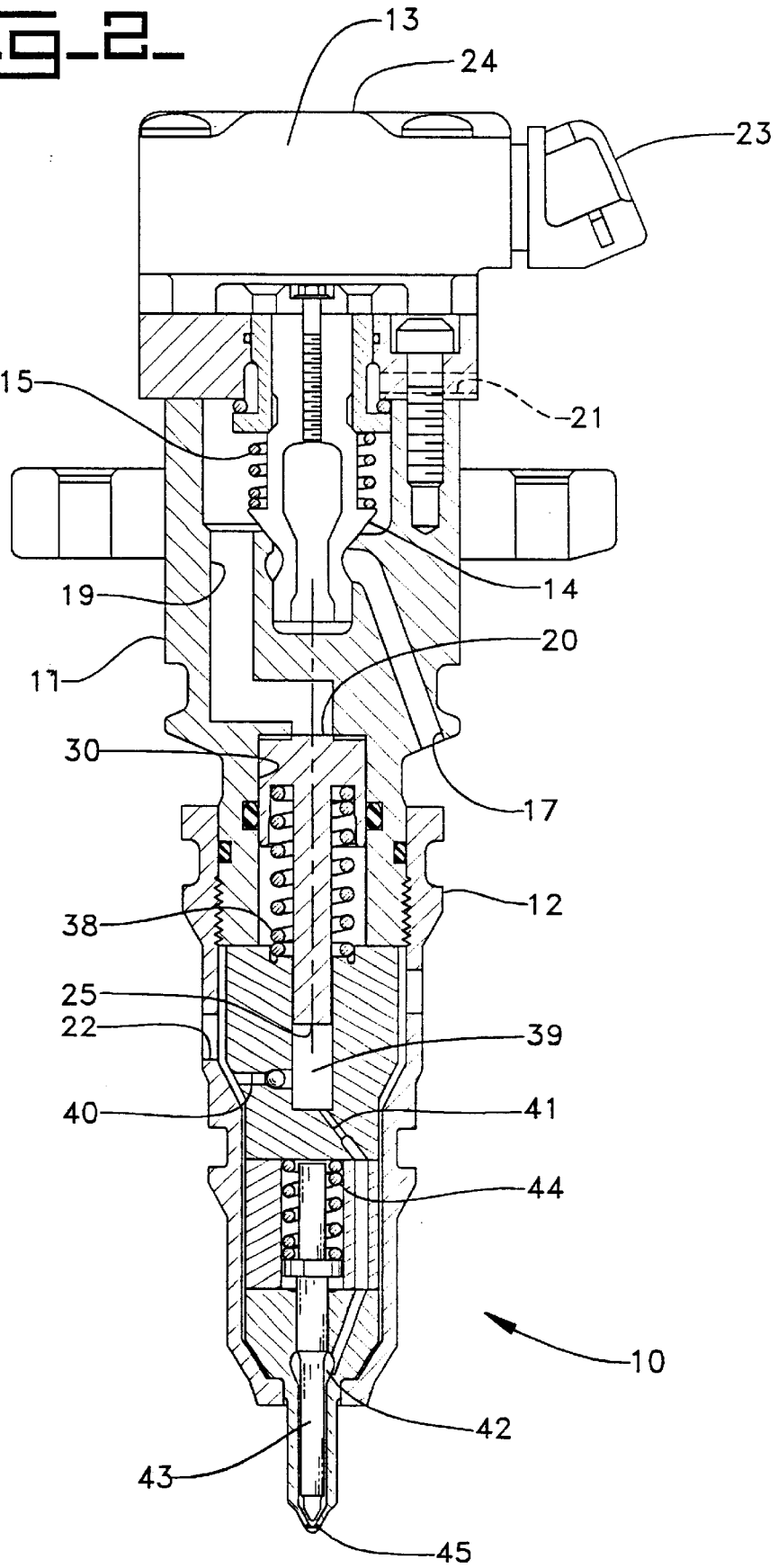
FIG. 2 is a diagrammatic side cross-section of one of the hydraulically-actuated fuel injectors shown in the fuel injection system of FIG. 1.

Referring to FIG. 1, there is shown the hydraulically-actuated fuel injection system 60 as adapted for a direct injection diesel cycle internal combustion engine. The fuel injection system 60 includes at least one fuel injector 10, all of which are adapted to be positioned in a respective cylinder head bore of the engine. The fuel injection system 60 includes a source of actuation fluid 16 for supplying actuation fluid to each fuel injector 10 at an actuation fluid inlet 17 (FIG. 2) and a source of fuel 18 for supplying fuel to each fuel injector 10 at a fuel inlet 22 (FIG. 2). The fuel injection system 60 also includes a means for recirculating actuation fluid 72, containing a hydraulic motor 75, which is capable of recovering hydraulic energy from the actuation fluid leaving each of the fuel injectors 10. A computer 70 is also included to control the fuel injection system 60.

The source of actuation fluid 16 preferably includes an actuation fluid sump 74, a low pressure actuation fluid transfer pump 76, an actuation fluid cooler 78, one or more actuation fluid filters 80, a high pressure actuation fluid pump 82 for generating high pressure in the actuation fluid and at least one actuation manifold 86. A high pressure common rail passage 88 is arranged in fluid communication with the outlet from the high pressure actuation fluid pump 82. A rail branch passage 90 connects the high pressure actuation fluid inlet 17 (FIG. 2) of each fuel injector 10 to the high pressure common rail passage 88. After performing work in the fuel injector 10, the actuation fluid exits the fuel injector 10 through a low pressure actuation fluid drain 21 (FIG. 2). The low pressure actuation fluid drain 21 (FIG. 2) is connected to the means for recirculating actuation fluid 72 via a recirculation passage 77 that carries the fluid to the hydraulic energy recirculating or recovering means 72. A portion of the recirculated actuation fluid is channeled to the high pressure actuation pump 82 and another portion is returned to the actuation fluid sump 74 via a recirculation line 83.

Any available engine fluid is preferably used as the actuation fluid in the present system. Here the actuation fluid is engine lubricating oil and the actuation fluid sump 74 is an engine lubricating oil sump. This allows the fuel injection system 60 to be connected directly into the engine's lubricating oil circulation system. Alternatively, the actuation fluid could be provided by a fuel tank 92 or another source, such as coolant fluid.

The source of fuel 18 preferably includes a fuel supply regulating valve 99 and a fuel circulation and return passage 97 arranged in fluid communication between the fuel injectors 10 and the fuel tank 92. Fuel is supplied to the fuel injectors 10 via a fuel supply passage 94 arranged in fluid communication between the fuel tank 92 and the fuel inlet 22 (FIG. 2) of each fuel injector 10. Fuel being supplied through the fuel supply passage 94 travels through a low pressure fuel transfer pump 96 and one or more fuel filters 98.

The computer 70 includes an electronic control module 61 which controls the timing and duration of injection events as well as several other parameters including desired performance, acceptable noise, acceptable emissions, etc. Based on input from these parameters, the electronic control module 61 can determine the present operating condition. Contained within the electronic control module 61 is a memory unit containing tables of nominal injector on-times. These nominal on-times represent some optimal compromise between desired performance and acceptable noise and emissions levels.

Referring now to FIG. 2, there is shown one of the hydraulically-actuated fuel injectors 10 from the fuel injection system 60 shown in FIG. 1. The Fuel injector 10 contains a top surface 24 as well as an upper injector body 11 and a lower injector body 12 that together contain various components that are attached to one another in a manner well known in the art and positioned as they would be just prior to an injection event. In particular, a solenoid 13 is attached to an electronic connection 23 and is deactivated such that a control valve member 14 is seated by the action of a biasing spring 15 to close the actuation fluid inlet 17 from an actuation fluid cavity 19. When the control valve member 14 is seated as shown, the actuation fluid within the actuation fluid cavity 19 is open to the low pressure actuation fluid drain 21.

Because of the lower pressure in the actuation fluid cavity 19, when the solenoid 13 is deactivated, an intensifier piston 20 is biased to its retracted position, as shown, within a piston bore 30 by a return spring 38. A portion of the intensifier piston 20 is a plunger 25, which draws fuel into a fuel pressurization chamber 39 through the fuel inlet 22, via a fuel inlet passage 40 during the upward return stroke of the plunger 25. Although the intensifier piston 20 and the plunger 25 are shown as an integral body, it is to be understood that they may be separate, engaged elements.

When plunger 25 is undergoing its downward pumping stroke, fuel exits the fuel pressurization chamber 39 into a nozzle chamber 42 via a nozzle supply passage 41. When the pressure of the fuel in the fuel pressurization chamber 39 is below valve opening pressure, a needle check valve 43 prevents the flow of that fuel from the fuel pressurization chamber 39 into the combustion chamber by blocking a nozzle outlet 45. The needle check valve 43, which is normally biased downward by a biasing spring 44, includes a lifting hydraulic surface(s) which is exposed to pressure from the fuel within the nozzle chamber 42. When the fuel pressure within the fuel pressurization chamber 39 reaches valve opening pressure the pressure is sufficient to move the needle check valve 43 against the action of the biasing spring 44, to open the nozzle outlet 45. The fuel within the fuel pressurization chamber 39 is then permitted to flow through the nozzle supply passage 41 into the nozzle chamber 42 and out of the nozzle outlet 45. At the end of the injection event, when the fuel pressure within the fuel pressurization chamber 39 drops below a valve closing pressure, the needle check valve 43 returns to the biased position closing the nozzle outlet 45 and ending the fuel flow into the combustion space.

Figure 3:
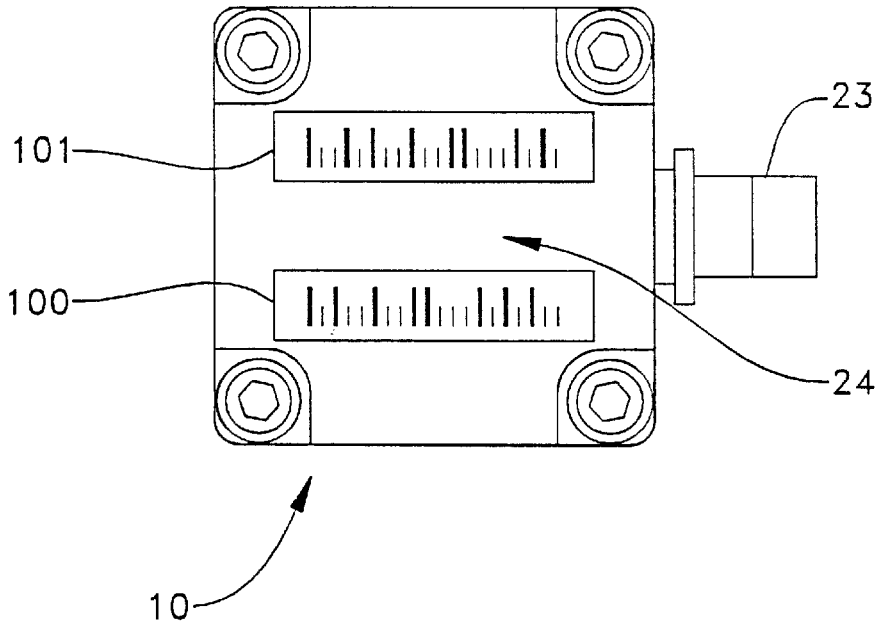
FIG. 3 is a diagrammatic top view of the hydraulically-actuated fuel injector of FIG. 2.
Figure 4:
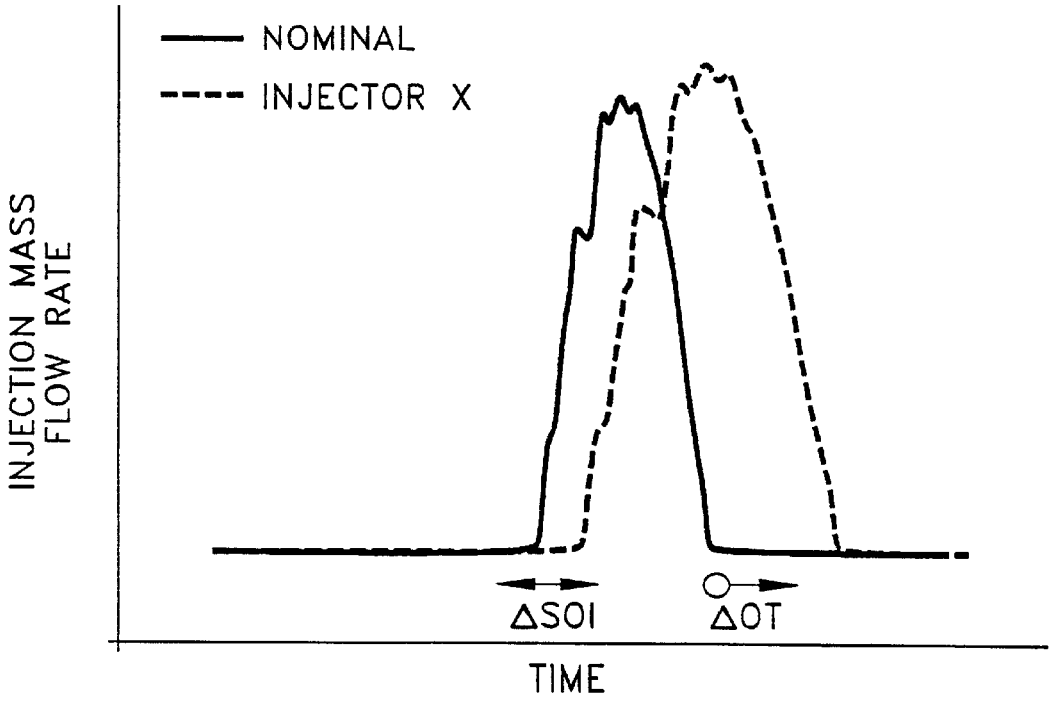
FIG. 4 is a graph of injection mass flow versus time for a nominal injector and an actual hydraulically-actuated fuel injector for a single injection event.
Figure 5A:
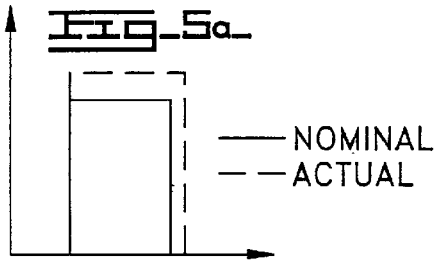
FIGS. 5*a*–5*f* are graphical representations of the injection mass flow versus time for a nominal injector and an actual hydraulically-actuated fuel injector prior to any on-time adjustment for a single injection event.
Figure 6A:
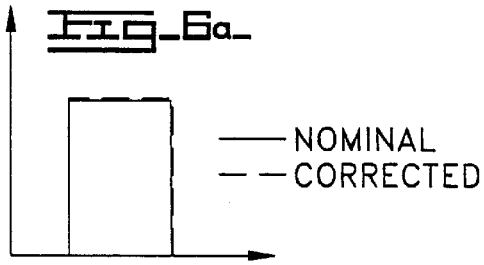
FIGS. 6*a*–6*f* are graphical representations of the injection mass flow versus time for a nominal injector and an actual hydraulically-actuated fuel injector for a single injection event, after an on-time adjustment calculated by the present invention.
Figure 5B:
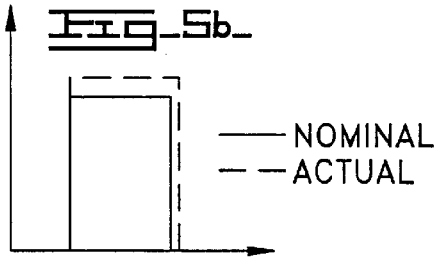
Figure 6B:
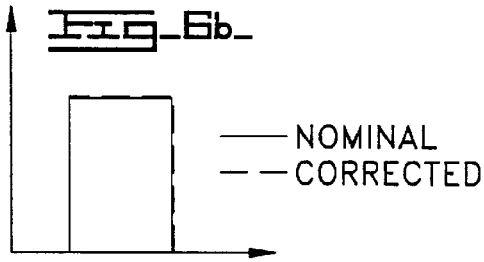
Figure 5C:
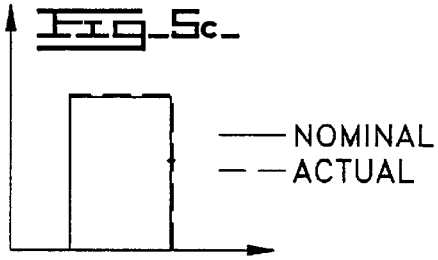
Figure 6C:
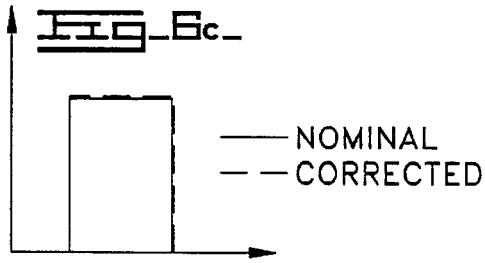
Figure 5D:
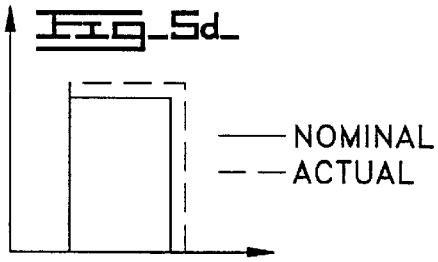
Figure 6D:
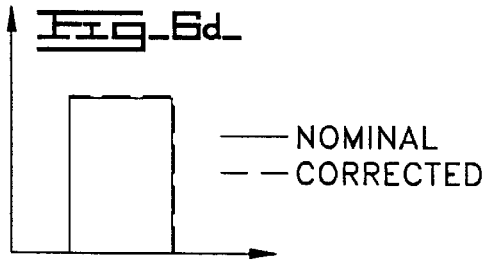
Figure 5E:
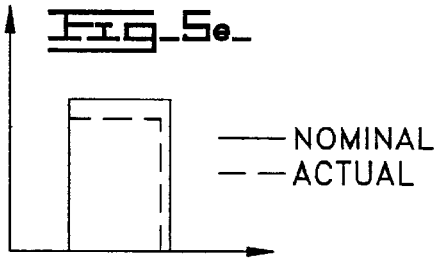
Figure 6E:
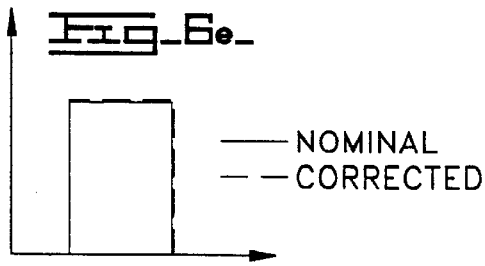
Figure 5F:
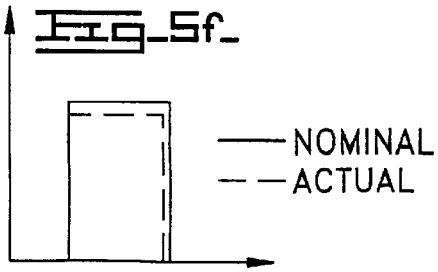
Figure 6F:
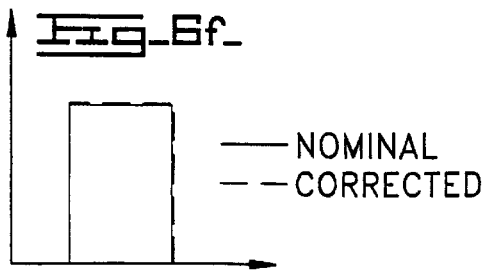

Referring now to FIG. 3, there is shown the top surface 24 of one of the hydraulically-actuated fuel injectors 10 shown in FIG. 2. The top surface 24 includes a serial number 101 used to catalog the fuel injector 10. The top surface 24 also includes a bar-code 100 which represents the results of the tests performed on the fuel injector 10. The bar-code 100 can be scanned at the installation site, prior to installation, to access the results of those tests. These results can then be stored in the memory unit contained within the electronic control module 61.

Currently, when a hydraulically-actuated fuel injector is manufactured, a single test is performed at one operating condition to determine the volume of fuel that is sprayed by the fuel injector. If this volume falls within an acceptable range, as predetermined by a nominal injector, the fuel injector is approved and marked with a serial number. The result of the test is recorded and referenced to the serial number for possible future use if the fuel injector is ever returned due to a malfunction. However, this result does not travel with the fuel injector.

As stated previously, the prior art method of on-time adjustment monitors performance of the actual fuel injection system 60 and compares it to the expected performance. However, engineers have observed that one fuel injector may perform differently at different operating conditions.

The present invention, therefore, alters the prior art method by performing at least two tests on each fuel injector, preferably one at an idle condition and another at a rated condition. Further, by including a bar-code on each fuel injector capable of storing the results of the tests, the present invention allows the test results to be carried by the fuel injector for access at installation by an electronic control module in a fuel injection system. These results can then be stored in a memory unit within the electronic control module when the fuel injector is installed in the fuel injection system.

The present invention makes the fuel injector 10 perform more like a nominal injector, tunes the fuel injection system 60 and improves performance of the engine. At least two tests must be performed for each fuel injector 10 preferably prior to installation in a fuel injection system 60 and preferably at different operating conditions. More than one test is required because the fuel injectors 10 tend to behave differently at different operating conditions. Further, in order to better assess the performance characteristics of each fuel injector 10 across its operating range, one test should be performed at a short injection duration and at least one test should be run at a long duration. The results of these tests can then be utilized to calculate an on-time adjustment, or electronic trim solution, for the fuel injector 10 so that it performs more like a nominal injector when actually installed in an engine.

Testing has shown that individual fuel injector 10 performance variation from the nominal injector performance varies with the on-time of the individual fuel injector 10. For instance, one fuel injector 10 might consume less fuel than the nominal injector at a short injection duration but more fuel than the nominal injector at a long injection duration. A second fuel injector 10, however, might consume less fuel than the nominal injector at both durations. Thus, an electronic trim solution according to the present invention should be a function of the nominal on-time of the system.

In addition to the variation in fuel injector 10 performance with respect to nominal on-time, and probably more importantly, the performance of an individual fuel injector 10 has been found to vary based on the rail pressure of the fuel injection system 60. For instance, at a fixed on-time, one fuel injector 10 might inject an insufficient volume of fuel at a low rail pressure and an excess volume of fuel at a high rail pressure. A second fuel injector 10, however, might inject an excess volume of fuel at both the low and high rail pressure for a fixed on-time. Thus, the electronic trim solution should also preferably be a function of rail pressure of the fuel injection system 60.

In the preferred method of this invention, the electronic trim solution for the fuel injector 10 is determined by first calculating the difference in delivery between the actual fuel injector 10 and the nominal injector. For the purposes of this invention, a nominal injector is a theoretical perfectly performing injector without any variations due to tolerencing or other manufacturing considerations. The difference in delivery is a function of the results of the tests, preferably performed at the idle and rated operating conditions. Preferably, the difference in delivery is estimated as a linear relationship. This linear relationship can be represented as:

$$\Delta Del = a_1 + a_2\,(rp) \tag{1}$$

where rp is the rail pressure of the fuel injection system 60 and $a_1$ and $a_2$ are constants to be determined from the test results. Because the constants $a_1$ and $a_2$ are determined based on the results of the tests, they will be different for each fuel injector 10. This equation is solved for the particular fuel injection system 60 by measuring the difference in delivery at two conditions from the stored test results. The nominal delivery at each of these same conditions is already known and can be used to calculate the difference in delivery between the actual fuel injector 10 and the nominal injector at each of the two conditions. Using the calculated values for the difference in delivery at the two conditions, the constants, $a_1$ and $a_2$, in equation (1) can be solved yielding an equation that will calculate the difference in delivery between the actual fuel injector 10 and the nominal injector across the rail pressure range of the fuel injector 10.

Once the difference in delivery is determined for the fuel injector 10 as a function of the rail pressure, this solution is used to determine the electronic trim solution for the fuel injector 10. A slope of the delivery curve is defined as the gain in delivery for a change in on-time (ΔOt):

$$slope = \Delta Del/\Delta Ot \text{ or, } \Delta Ot = \Delta Del/slope \tag{2}$$

The slope of the actual delivery curve is unknown at all points on the delivery map. While the performance of the actual fuel injector 10 deviates from that of the nominal injector, the slope of their delivery curves should be very close. Therefore, the slope of the nominal delivery curve, which is stored or can be calculated, can be substituted for that of the actual delivery curve. Thus, the electronic trim solution for the fuel injector 10 can be calculated as:

$$\Delta Ot = \Delta Del/slopeN \text{ or,}$$

$$\Delta Ot = [a_1 + a_2\,(rp)]/slopeN \tag{3}$$

where slopeN is the slope of the nominal delivery curve and Δ Ot is the change in on-time. Equation (3) can then be stored in the electronic control module 61 and solved for the electronic trim solution for each fuel injector 10 in the system.

For example, if the two conditions, A and B, are chosen as (3.8 MPa, 1.3 msec) and (23 MPa, 1.3 msec), respectively, the difference in delivery can be calculated as the difference between the known nominal delivery for the nominal injector at these conditions and the stored value of delivery for the actual fuel injector 10. The delivery at these two conditions can be measured as Del (A)=6.877 $mm_3$ and Del (B)=67.248 $mm^3$. The nominal delivery at each of these same conditions is already known as DelN (A)=7.377 $mm_3$ and DelN (B)=70.584 $mm^3$. Therefore, the difference in delivery at both of these conditions can be calculated as:

$$\Delta Del\ (A) = 0.5\ mm^3 \text{ and } \Delta Del\ (B) = 3.336\ mm^3$$

These values can then be used to solve equation (1) for the actual fuel injector 10. Using the calculated values for selected conditions A and B, equation (1) becomes:

$$\Delta Del = -0.07915 + (0.1485)\ rp \tag{4}$$

for this fuel injector 10. Equation (4) can be used to calculate the difference in delivery between this actual fuel injector 10 and the nominal injector across the rail pressure range of the fuel injector 10.

Once the difference in delivery is determined for the fuel injector 10 as a function of the rail pressure, this solution can be used to determined the electronic trim solution. The slope of the nominal delivery curve is stored at all operating conditions. Using the stored nominal slope, equation (3) becomes:

$$\Delta Ot = [-0.07915 + (0.1485)rp]\ slopeN \tag{5}$$

Thus, equation (5) yields the electronic trim solution for the individual fuel injector 10. The electronic trim solution used to adjust the on-time of the fuel injector 10 after installation in the fuel injection system 60 can be solved from equation (3), which was stored in the electronic control module 61. When calculating the electronic trim solution for each fuel injector 10, the rail pressure of the system and nominal slope will remain the same, however, the value of constants $a_1$, and $a_2$ will be different. This will result in different electronic trim solutions for each fuel injector 10. In addition to allowing the electronic control module 61 to calculate the value of constants $a_1$, and $a_2$, these values could be accessed from a remote location by use of the serial number 101 or the bar-code 100.

In another method of this invention, the electronic trim solution can be calculated only as a function of the rail pressure of the fuel injection system 60. This method will yield weaker results than the preferred method at lower on-time values in part because their is no implicit account for the on-time variation in the calculations. A linear relationship estimate between electronic trim solution and rail pressure of the fuel injection system can be represented as:

$$\Delta Ot=b_1+b_2\,(rp) \tag{6}$$

where rp is the rail pressure of the fuel injection system 60 and $b_1$ and $b_2$ are constants which will be determined from the test results. Once again, the constants will be different for each fuel injector 10 because they are calculated as a function of the test results. This equation is solved by measuring the delivery of the fuel injector 10 at two different conditions, A and B, from the stored test results. Conditions A and B are preferably an idle and a rated condition. The nominal delivery at each of these conditions is already known and can be used to calculate the difference in delivery between the actual fuel injector 10 and the nominal injector at each of these two conditions.

Once the difference in delivery at each of the selected conditions has been calculated, the slope of the delivery curve is defined as the gain in delivery for a change in on time. This can be represented as:

$$slope(A)=\Delta Del\ (A)/\Delta Ot\ (A)\ \& \tag{7}$$

$$slope(B)=\Delta Del\ (B)/\Delta Ot\ (B) \tag{8}$$

Once again the slope of the actual fuel injector 10 is unknown at all points on the delivery map. However, the known slope of the nominal delivery curve is stored, or can be calculated, and can be substituted for that of the actual delivery curve. Therefore, equations (7) and (8) can be restated as:

$$\Delta Ot\ (A)=\Delta Del\ (A)/slopeN\ (A)\ \& \tag{9}$$

$$\Delta Ot\ (B)=\Delta Del\ (B)/slopeN\ (B) \tag{10}$$

where slopeN (X) is equal to the slope of the nominal curve for that condition. Equations (9) and (10) can then be solved to yield the electronic trim for the actual fuel injector 10 at two specific conditions. These two electronic trim values can be used to solve equation (6) to produce an electronic trim solution for the actual fuel injector 10 and the fuel injection system 60.

For example, if conditions A and B are again selected as (3.8 MPa, 1.3 msec) and (23 MPa, 1.3 msec), respectively, the difference in delivery can be calculated as the difference between the known nominal delivery for the nominal injector at these conditions and the stored value of delivery for the actual fuel injector 10. The delivery at these two conditions can again be measured as Del (A)=6.877 $mm^3$ and Del (B)=67.248 $mm^3$. The nominal delivery at each of these same conditions is already known as DelN (A)=7.377 $mm^3$ and DelN (B)=70.584 $mm^3$. Therefore, the difference in delivery at both of these conditions can be calculated as $$\Delta Del\ (A)=0.5\ mm^3 \text{ and } \Delta Del\ (B)=3.336\ mm^3$$

Once the difference in delivery for each of these conditions is determined, the slope of the nominal delivery curve for each of these conditions is needed. The slope of the nominal delivery curve at the two selected conditions is stored, or can be calculated, as:

$$slopeN\ (A)=6.469\ mm^3 msec \text{ and}$$

$$slopeN\ (B)=100.512\ mm^3/msec$$

The difference in delivery and the nominal slope for each condition can now be used to solve equations (9) and (10) to yield:

$$\Delta Ot\ (A)=0.07729\ msec \text{ and}$$

$$\Delta Ot\ (B)=0.3319\ msec$$

Using these values for selected conditions A and B, equation (6) becomes:

$$\Delta Ot=0.08629+(-2.31\ E\ -03)\ rp \tag{11}$$

Thus, equation (11) yields the electronic trim solution for the individual fuel injector 10. Once again, this electronic trim solution can be solved from equation (6) which is stored in the electronic control module 61 and used to adjust the on-time of the fuel injector 10 after installation in the fuel injection system 60. When calculating the electronic trim solution for each fuel injector 10, the rail pressure of the system and the nominal slope will remain the same, however, the value of constants $b_1$ and $b_2$ will be different. This will result in different electronic trim solutions for each fuel injector 10. In addition to allowing the electronic control module 61 to calculate the value of constants $b_1$ and $b_2$, these values could be accessed from a remote location by use of the serial number 101 or the barcode 100.

Industrial Applicability

Referring now to FIGS. 1–3, prior to the installation of the fuel injector 10 into the fuel injection system 60, at least two tests are performed on the fuel injector 10. The results of these tests are then recorded and the fuel injector 10 is preferably marked with the bar-code 100 capable of representing those results. Just prior to installation of the fuel injector 10 into the fuel injection system 60, the bar-code 100 on the fuel injector 10 is scanned to access the results of the tests. These results are then installed into the memory unit and the fuel injector 10 is installed into the fuel injection system 60. In addition, the electronic trim equation, equation (3), for the fuel injector 10 is programmed into the software of the electronic control module 61. Before energizing the fuel injector 10, the electronic trim equation is solved for that particular operating condition. Using these electronic trim solutions, the electronic control module 61 adjusts the on-time for each fuel injector 10 accordingly.

When the fuel injection system 60 is in operation, the electronic control module 61 is responsible for tracking which fuel injectors 10 will fire, in what order and at what time. When an injection event is approaching for a particular fuel injector 10, the electronic control module 61 decides when the nominal injector would need energized and the duration of the nominal injector's injection event. The electronic control module 61 must then sense the conditions and calculate an electronic trim solution for the actual fuel injector 10. The on-time for the fuel injector 10 is then adjusted based on the electronic trim solution and the solenoid 13 of the fuel injector 10 is energized. The adjusted on-time is equal to the on-time of the fuel injector 10 plus the on-time adjustment which may be a positive or negative value.

Once the solenoid 13 is energized, the control valve member 14 is lifted off of its seat to allow high pressure actuation fluid into the actuation fluid cavity 19. The high pressure actuation fluid then acts on the top of the intensifier piston 20 to make it move toward its advanced position against the action of the return spring 38. The downward movement of the intensifier piston 20 is accompanied by the downward movement of the plunger 25 to compress and raise the pressure of the fuel within the fuel pressurization chamber 39. Downward movement of the plunger 25 causes fuel pressure in the fuel pressurization chamber 39 to rise. This movement of the plunger 25 also causes the fuel in the fuel pressurization chamber 39 to exit through the nozzle supply passage 41 and the nozzle chamber 42. The pressurized fuel then surrounds the shoulder of the needle check valve 43 causing it to lift against the action of the biasing spring 44. When the fuel pressure reaches valve opening pressure, the needle check valve 43 is lifted off of its seat and fuel injection begins through the nozzle outlet 45.

Shortly before the desired amount of fuel has been injected through the nozzle outlet 45, the electronic control module de-energizes the solenoid 13. The solenoid 13 then allows the control valve member 14 to return to its seat under the action of the biasing spring 15. The actuation fluid inlet 17 is then closed preventing further flow of actuation fluid from the source 16. When the control valve member 14 returns to its seat, the low pressure actuation fluid drain 21 is opened. This causes the pressure in the actuation fluid cavity 19 to drop, which in turn causes the intensifier piston 20, and the plunger 25 to stop their downward stroke. Because the plunger 25 is no longer moving downward, the pressure of the fuel within the fuel pressurization chamber 39 begins to drop. When the pressure of this fuel falls below the valve closing pressure, the needle check valve 43 returns to its downward position to close the nozzle outlet 45 and end the injection event.

Between injection events, actuation fluid in the actuation fluid cavity 19 can then exit the fuel injector 10 for recirculation via the low pressure actuation fluid drain 21. The drop in pressure within the actuation fluid cavity 19 allows the intensifier piston 20 to be returned to its retracted position by the return spring 38. This retraction of the intensifier piston 20 is accompanied by the retraction of the plunger 25. When the plunger 25 retracts, fuel is drawn into the fuel pressurization chamber 39 via the fuel inlet 22.

Because each fuel injector 10 is corrected as a function of its unique performance, all fuel injectors 10 within the fuel injection system 60 are made to function almost identical to the nominal performance level. (FIGS. 7*a*–7*f*). This results in enhanced performance of the entire fuel injection system 60. Since the fuel injectors 10 are adjusted to perform according to their individual capabilities, all fuel injectors 10 will perform better, rather than implementing modifications that make some perform better at the expense of making others perform worse, as with the average correction discussed in the background. Therefore, the noise and emissions of the engine are dramatically reduced. Further, because all fuel injectors 10 are modified to perform at improved levels, the engine vibration is reduced and the variability of engines is reduced.

It should be understood that the above description is intended only to illustrate the concepts of the present invention, and is not intended to in any way limit the potential scope of the present invention. For instance, other performance parameters such as temperature or viscosity could be included in calculating the electronic trim solution. Further, rather than using a linear relationship between rail pressure of the fuel injection system 60 and the difference in delivery, higher order relationships could be used. Use of higher order relationships would require the use of more constants, and therefore more tests to be performed on the fuel injector 10. The number of tests to be performed must be balanced with the cost and time required to perform these tests. Therefore, a strong desire to minimize cost and time will lead to a use of a lower number of tests. Thus, various modifications could be made without departing from the intended spirit and scope of the invention as defined by the claims below.

What is claimed is:

1. A method of preparing an electronically controlled fuel injector for tuning, comprising the steps of:

performing a first injection with said fuel injector at a first condition that includes a first rail pressure;

recording a first injection result;

performing a second injection with said fuel injector at a second condition that includes a second rail pressure which is different from said first rail pressure;

recording a second injection result; and providing information for programming an electronic control module to adjust an on-time for said fuel injector based upon said first injection result and said second injection result.

2. The method of claim 1 wherein said first condition includes a relatively short injection duration; and said second condition includes a relatively long injection duration.

3. The method of claim 1 wherein said first condition corresponds to an idle operating condition; and said second condition corresponds to a rated operating condition.

4. The method of claim 1 wherein said step of providing information includes a step of attaching coded information to said fuel injector.

5. The method of claim 4 wherein said step of attaching coded information includes a step of attaching a bar code to said fuel injector.

6. A method of tuning an electronically controlled fuel injection system, comprising the steps of:

reading first performance characteristics of an individual fuel injector at a first rail pressure into an electronic control module;

reading second performance characteristics of said fuel injector at a second rail pressure into an electronic control module; and programming said electronic control module to adjust on-times for said fuel injector based upon said first performance characteristics and said second performance characteristics.

7. The method of claim 5 including a step of calculating an on-time adjustment as a function of a rail pressure.

8. The method of claim 6 including a step of calculating an on-time adjustment as a function of a nominal on-time.

9. The method of claim 6 including a step of storing a delivery curve slope for said nominal injector in said electronic control module; and calculating an on-time adjustment as a function of said delivery curve slope.

10. The method of claim 6 including a step of combining a nominal on-time with an on-time adjustment to produce an adjusted on-time for said fuel injector.

11. The method of claim 6 wherein said step of installing performance characteristics includes a step of scanning coded information from a code attached to the fuel injector.

12. The method of claim 6 including a step of installing said fuel injector into an engine.

* * * * *

UNITED STATES PATENT AND TRADEMARK OFFICE

CERTIFICATE OF CORRECTION

PATENT NO. : 6,357,420 B1
DATED : March 19, 2002
INVENTOR(S) : Matta, George M.

It is certified that error appears in the above-identified patent and that said Letters Patent is hereby corrected as shown below:

Title page, Item [54] and Column 1, line 1,
The title should be as follows: -- METHOD OF TUNING FUEL INJECTION SYSTEMS BASED ON ELECTRONIC TRIM --

Signed and Sealed this

Twenty-fourth Day of September, 2002

*Attest:*

*Attesting Officer*

JAMES E. ROGAN
*Director of the United States Patent and Trademark Office*